US006755553B1

(12) United States Patent
Battle

(10) Patent No.: US 6,755,553 B1
(45) Date of Patent: Jun. 29, 2004

(54) CORDELESS LIGHT EMITTING DISPLAY APPARATUS

(76) Inventor: Doreatha L. Battle, 3652 Daughteridge Dr., Fayetteville, NC (US) 28311

( * ) Notice: Subject to any disclaimer, the term of this patent is extended or adjusted under 35 U.S.C. 154(b) by 115 days.

(21) Appl. No.: 10/056,400

(22) Filed: Jan. 24, 2002

(51) Int. Cl.[7] ..... F21V 23/04; F21V 21/22

(52) U.S. Cl. ..... 362/251; 362/145; 362/183; 362/191; 362/250

(58) Field of Search ..... 362/183, 184, 362/145, 151, 152, 225, 227, 249, 250, 396, 157, 234, 240, 186, 190, 191, 494, 251; 40/541, 550, 564, 579, 580, 606.01, 607.11, 607.12, 611.01

(56) References Cited

U.S. PATENT DOCUMENTS

| | | | | | |
|---|---|---|---|---|---|
| 3,762,119 | A | * | 10/1973 | Sowle | 40/564 |
| 4,443,831 | A | * | 4/1984 | Godfrey et al. | 362/184 |
| 4,718,185 | A | * | 1/1988 | Conlin et al. | 362/183 |
| 4,821,158 | A | | 4/1989 | Mitten | 362/249 |
| 4,843,525 | A | * | 6/1989 | Williams | 362/183 |
| 4,974,129 | A | * | 11/1990 | Grieb et al. | 362/191 |
| 4,995,181 | A | | 2/1991 | Wolf | 40/152.2 |
| 5,007,190 | A | * | 4/1991 | Shyu | 40/564 |
| 5,067,061 | A | | 11/1991 | Pricket | 362/145 |
| 5,097,612 | A | * | 3/1992 | Williams | 40/550 |
| 5,161,882 | A | | 11/1992 | Garrett | 362/249 |
| 5,220,739 | A | * | 6/1993 | Chich et al. | 40/564 |
| 5,453,729 | A | * | 9/1995 | Chu | 362/183 |
| 5,544,028 | A | | 8/1996 | Carlin | 362/249 |
| 5,559,681 | A | | 9/1996 | Duarte | 362/252 |
| 5,575,098 | A | * | 11/1996 | Goettel-Schwartz | 40/550 |
| 5,582,478 | A | * | 12/1996 | Ambrosino | 362/234 |
| 5,630,660 | A | * | 5/1997 | Chen | 362/183 |
| 5,664,874 | A | * | 9/1997 | Winterer | 362/191 |
| 5,791,762 | A | | 8/1998 | Wroblewski | 362/152 |
| 5,890,794 | A | * | 4/1999 | Abtahi et al. | 362/184 |
| 6,092,318 | A | * | 7/2000 | Arie et al. | 40/550 |
| 6,098,326 | A | * | 8/2000 | Campbell, III | 40/564 |
| 6,186,644 | B1 | | 2/2001 | Mosseau | 362/249 |
| 6,364,273 | B1 | * | 4/2002 | Otema | 362/225 |
| 6,497,502 | B1 | * | 12/2002 | Clift et al. | 362/392 |

* cited by examiner

*Primary Examiner*—Alan Cariaso
(74) *Attorney, Agent, or Firm*—Technology Legal Counsel LLC

(57) ABSTRACT

A principal objective of the present invention is to provide a cordless display apparatus that is suitable for use in locations that are not located near an electrical outlet. In the furtherance of this and other objectives, the display apparatus is powered by at least one battery, or alternatively configured with solar powered cells that allow the display to be charged during the day and light emitting at night. The display assembly comprises an integrated housing defining a plurality of apertures for receiving light emitting elements. The housing further is coupled with a plurality of support members for secure and stable display of the apparatus. In a preferred embodiment, the housing can move telescopically longitudinally along the support members.

8 Claims, 5 Drawing Sheets

CORDELESS LIGHT EMITTING DISPLAY APPARATUS

FIELD OF THE INVENTION

The present invention relates generally to illumination devices and an apparatus for displaying light emitting elements in particular.

BACKGROUND OF THE INVENTION

For years families and businesses have displayed lights in their windows to commemorate some event or call attention to their window for some reason. In particular, during the Christmas and Hanukkah holiday seasons, the lights take on a special significance.

In order to avoid the dangers of using candles that could easily tip over and cause fires, people have turned to electric lighting to serve the same symbolic purpose. Historically strings of lights were affixed to the window parapet or alternatively, window fixtures were adopted to the window to display a multiplicity of colored light bulbs.

Many attempts have been made to perfect these window displays, however, they still suffer from the principal limitation of requiring an electrical outlet, located near the window, for proper function. In particular, when used outdoors, many of the conventional display devices require a series of extension cords and access to an electrical outlet. Moreover, depending on the number of lighting elements connected in series to the electrical outlet, the electrical circuit could be overloaded and cause a fire.

Additionally, the hassle of untangling extension cords and the cord of the lighting elements and display should be alleviated. An additional limitation of existing display devices results from the fact that manufactures would have to incur the added expense of designing the device to meet the varying forms of electrical current drawn from electrical outlets throughout the world. Yet another limitation of conventional display devices is the fact that they either require movable parts, that undergo significant stress when affixing them to a window parapet, or the display device is affixed by some sort of semi-permanent form of adhesion such as glue, nails, etc. In the case of moveable parts, such as spring loaded means, the tension on the springs leads to premature obsolescence of the securing means and therefore unsatisfactory positioning of the display device. With respect to using semi-permanent adhesion techniques, the device may be damaged when removing the adhesive. This may prevent the device from being place in another location, repaired or moved after the holiday season.

Therefore, there is an existing need for a decorative lighting display that utilizes a power source that allows the use of the display in locations that are difficult to reach without the use of an extension cord. Moreover, there is a need for a cordless display device that can be placed securely on a window parapet as well as adequately adapted for display in other desirable locations.

SUMMARY OF EXEMPLARY EMBODIMENTS

The present inventors have discovered a unique way of addressing all of the above limitations and providing additional advantages. In an exemplary embodiment in accordance with the present invention, a cordless light emitting display is provided.

In a preferred embodiment, it is an objective of the invention to provide a decorative display that can be placed, preferably, in a window parapet but is suitably configured to be displayed on, by way of example but not limited to, balcony's, deck railings, tables, car rear window wells, etc. In the furtherance of this and other objectives, a display apparatus is provided that can be slipped under the window in such a manner that the window holds the apparatus in place while still closing sufficiently to form an air tight seal. Moreover, when used outside of the window context, the display apparatus can sufficiently stand on its legs.

A principal objective of the present invention is to provide a cordless display apparatus that is suitable for use in locations that are not located near an electrical outlet. In the furtherance of this and other objectives, the display apparatus is powered by at least one battery, or alternatively configured with solar powered cells that allow the display to be charged during the day and light emitting at night.

Another objective of a preferred embodiment of the present invention is to provide a display apparatus that has adjustable legs so that the height of the light elements can be raised or lowered by telescoping the light element housing longitudinal along the legs.

Still another objective of the present inventions is to provide an alternative to the current systems that require additional moving parts such as spring loaded means, that are subject to obsolescence, to secure the display device in a window parapet. In the furtherance of this and other objectives, the display apparatus sits on support members that are engaged with the light emitting element housing.

Yet another objective of a preferred embodiment of the present invention is to provide a durable and lightweight display apparatus for display in diverse locations. In the furtherance of this and other objectives, the display apparatus in accordance with the present invention is formed from a shatter resistant and substantially translucent polymeric material and can be suitably configured with a hook for hanging the display apparatus in varying locations.

Further objectives, features and advantages of the invention will be apparent from the following detailed description taken in conjunction with the accompanying drawings.

DETAILED DESCRIPTION OF THE PREFERRED EMBODIMENTS

Figure 1B:
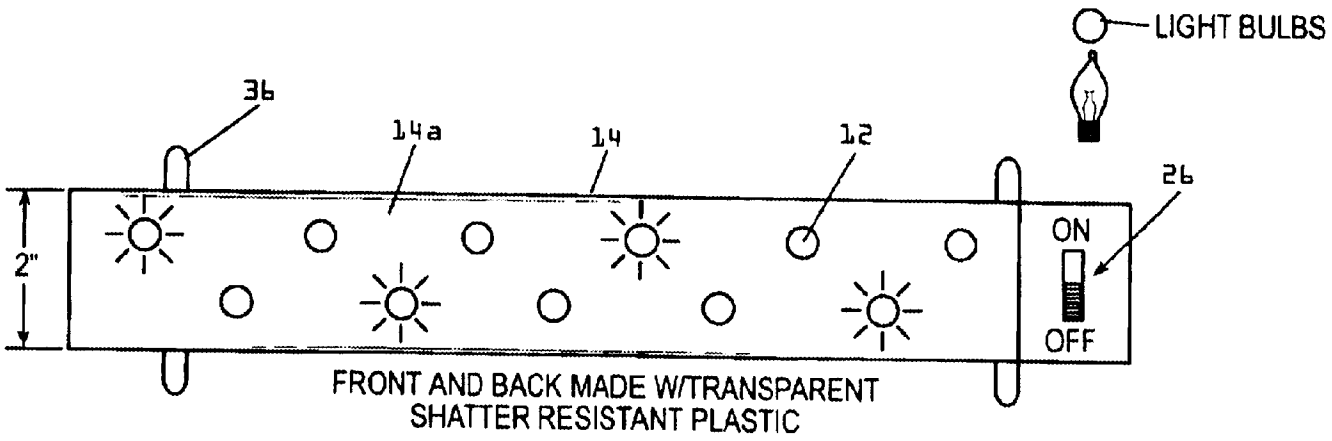
FIG. 1*b* is a front perspective view of a decorative display apparatus embodying the present invention, shown with a light emitting element housing in standard orientation with respect to the support members.
Figure 1A:
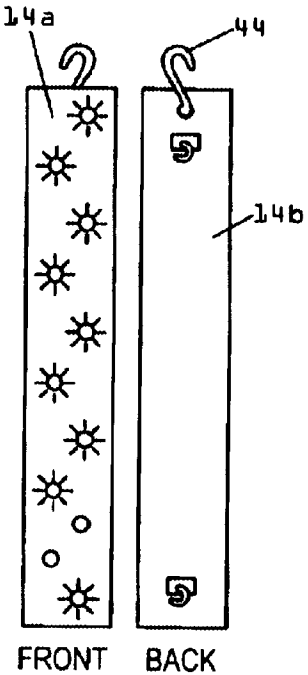
FIG. 1*a* is a front and back perspective view of a decorative display apparatus embodying the present invention.
Figure 1C:
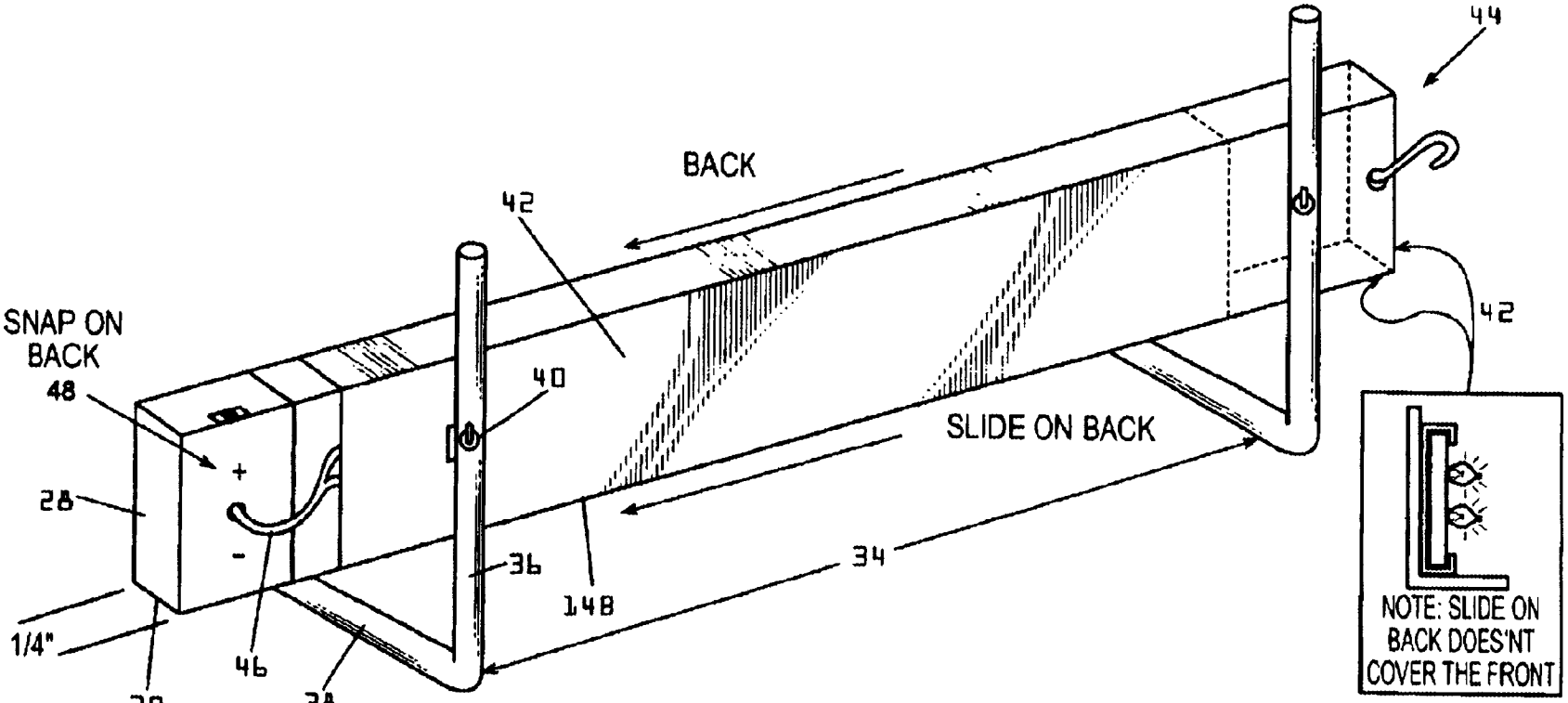
FIG. 1*c* is a rear perspective view of a decorative display apparatus embodying the present invention, shown with a light emitting element housing having a sliding back cover and a snap on power source compartment cover, in standard orientation with respect to the support members.

The present invention provides a decorative light emission display apparatus. Illustrated in FIGS. 1*a*–1*c* is a longitudinal portion of a decorative lighting system 10 that includes a multiplicity of light emitting elements 12 and a specially designed housing 14. As subsequently described, the housing 14 is operative to releasably hold the light emitting elements 12, and may be laterally secured to a surface, such as the top surface 16 of a window parapet 18 (FIG. 2), adjacent the front side 20 of the parapet. The lighting system 10 may be configured to resemble a ruler, having a width from front 14*a* to back 14*b* of about ¼" and a height from top to bottom of about 2". The length of the lighting system 10 could range from 2" to about 36". Please keep in mind that these dimensions are provided by way of example and are by no means to be construed as limiting.

Figure 4A:
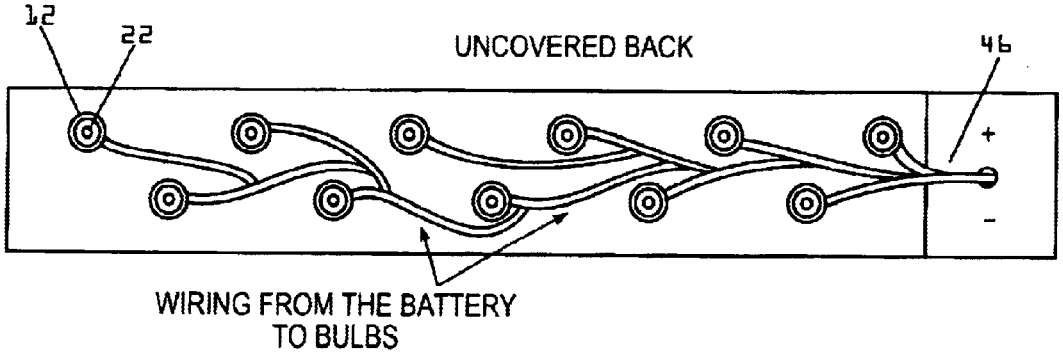
FIG. 4*a* is a rear perspective view of an alternative embodiment of the decorative display apparatus in accordance with the present invention, showing the innards of the housing with the sliding back cover removed.
Figure 4B:
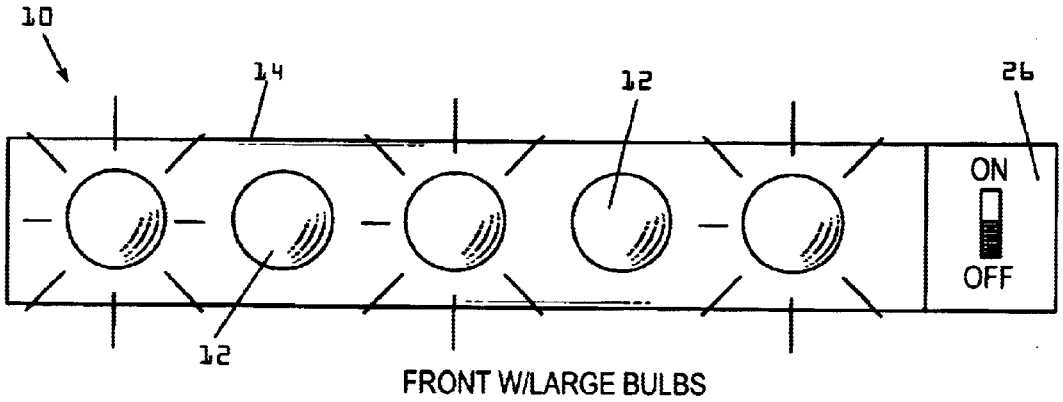
FIG. 4*b* is a front perspective view of an alternative embodiment of the decorative display apparatus in accordance with the present invention, showing large light emitting elements.
Figure 5:
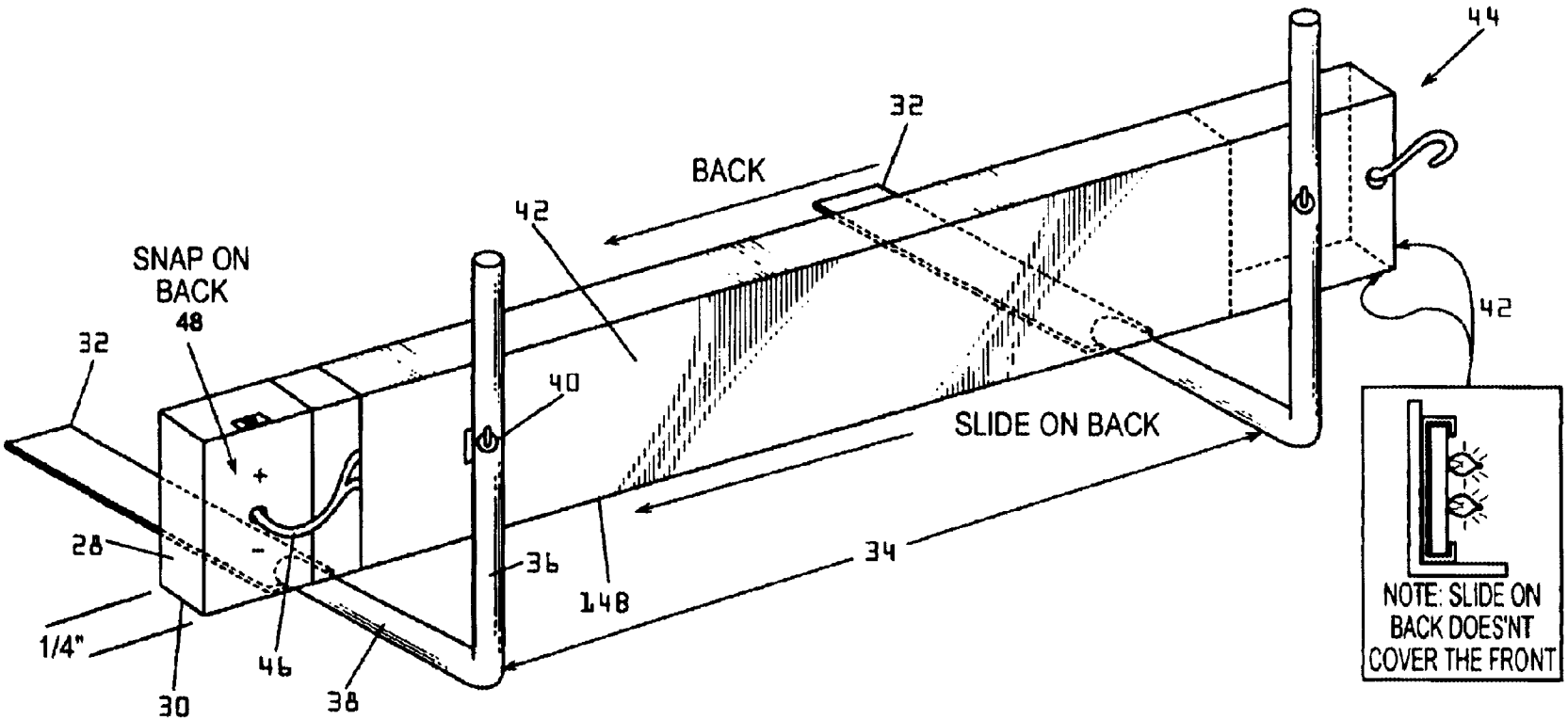
FIG. 5 is a rear perspective view showing an exemplary embodiment of the display apparatus, in accordance with one aspect of the present invention, where the display apparatus has support members.

A decorative lighting system 10, in accordance with the present invention, have a back cover 42 that is slideable along the back 14*b* of the housing 14. However, it must be kept in mind that other means of affixing the back cover 42 to the housing 14 may be employed, such as but not limited to snap on fitting, screw mounting etc). Though not equivalent, one of ordinary skill in the art would be able to adapt these means to the decorative lighting system 10 provided in this application. As shown in FIG 4*a,* when the back cover 42 is removed, the wiring 46 and light emitting element sockets 22 are exposed for diagnostic and repair purposes. FIG. 4*b* shows larger light emitting elements 12. The lighting system 10 can be configured such that either the front surface 14*a* the back surface 14*b* or anywhere there between can be coupled with a hook 44.

The housing 14 comprises a spaced series of cylindrical bulb sockets 22 having lower end portions 22*a* operatively interconnected to a power supply (not shown), and upper end portions 22*b* in which a series of light emitting elements 12 are received. The power supply could be a conventional battery or alternatively, a solar powered assembly. The solar power supply assembly could utilize conventional solar functionality as described in U.S. Pat. No. 6,027,225, which is incorporated herein by this reference, to achieve the novel object of providing a cordless decorative light emitting window display apparatus. The important factor is that the decorative light emitting element display apparatus 10 serves to eliminate the need for electrical outlets. It should be kept in mind that when the solar system is configured to illuminate when it is dark and then shut itself off when it is substantially light, substantially light equates roughly to the level of ambient light at dawn or lighter and substantially dark equates roughly to the level of ambient light at dusk or darker. Also, the decorative display apparatus 10 may be configured with a switch 26, that is operatively interconnected with the socket(s) 22 via housing 14 to allow the user of the display apparatus to regulate the light emission activity of the light emitting elements 12. The housing 14 has an elongated bottom sidewall 28 with a free longitudinal side edge 30.

Figure 2:
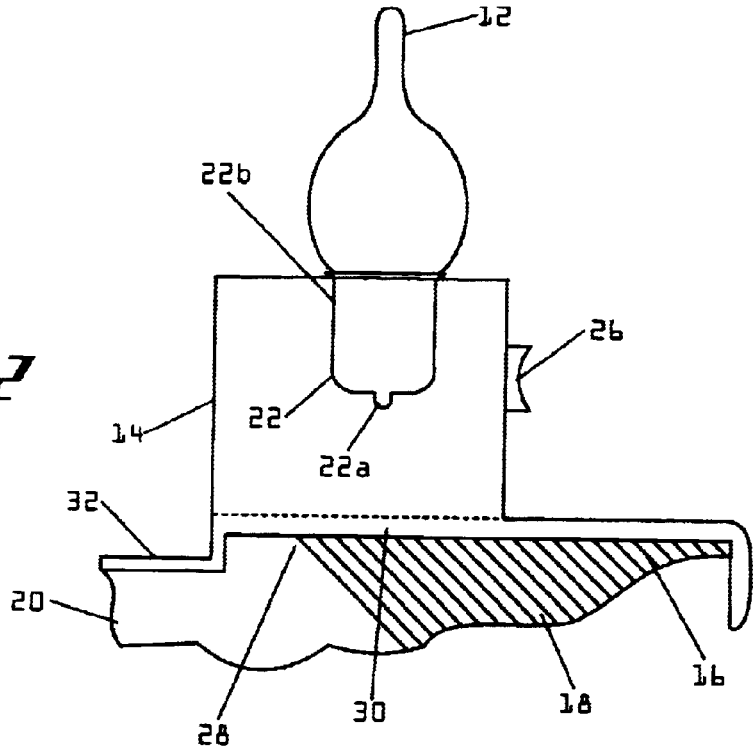
FIG. 2 is a top plan view of the decorative display apparatus as shown in FIG. 1.
Figure 3:
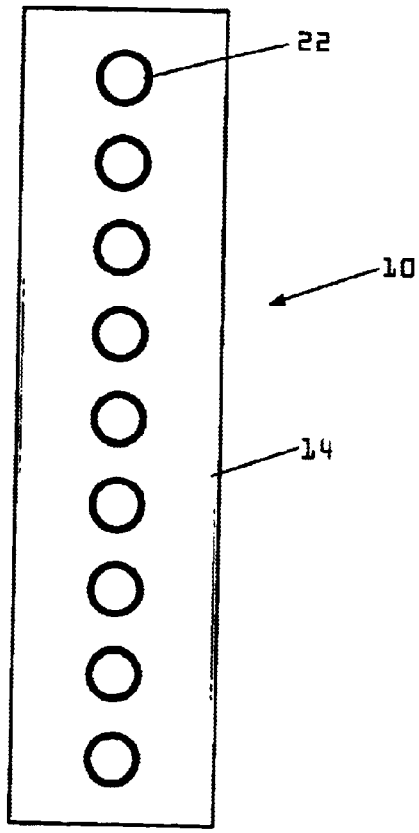
FIG. 3 is a transverse, cross-sectional view of a decorative display apparatus as shown in FIG. 1*b*.

Referring now to FIGS. 2 and 3, the decorative display apparatus 10 is installed on the window parapet 18 by lowering the window (not shown) in order to catch flange 32 between the bottom of the window and the top parapet surface 16, preferably forming a seal. If desired, other means may be utilized for securing the housing to the surface to be decoratively illuminated. The edges 32*a* and 32*b* of the catch flange may extend beyond the edges 14*a* and 14*b* of the housing 14 so as to ensure an airtight seal between the window, the window frame and the display apparatus 10. The light emitting elements 12 is then removably secured to the housing 14 by positioning the light emitting element 12 into the socket 22.

An alternate embodiment of the decorative light emitting element display apparatus 10 is depicted in FIGS. 1*b* and 1*c*. As shown in FIG. 1*c,* the housing 14 of the display apparatus 10 is coupled with a plurality of support members 34. In the event that the user of the display apparatus 10 desires to raise or lower the level at which the light emitting elements 12 are displayed, the display apparatus 10 can be suitably configured to allow the housing 14 to telescope longitudinally along the vertical expanse 36 of the support member 34, as the horizontal expanse 38 of the support member 34 is in flush contact with a surface, namely the window parapet 18. Moreover, the display apparatus 10 can further include an actuator 40 for facilitating the raising and lower of the housing with respect to the support members, and hold the housing in the desired location after a user has determined the desired location.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes, which come within the meaning and range of equivalency of the claims, are to be embraced within their scope.

What is claimed is:

1. A decorative cordless light emission element display apparatus comprising:

a plurality of light emitting elements;

a housing having a front surface, a back surface, first and second side surfaces, top and bottom surfaces, a surface of the housing defining a plurality of apertures therethrough for receiving and retaining in a reversible manner, the plurality of light emitting elements;

a plurality of support members coupled with a portion of the housing; a hook coupled with a portion of the housing; and a power supply in operative relation with the plurality of light emitting elements and coupled within the housing;

wherein the plurality of support members are configured such that a flange portion of the support member, distal to the housing can rest between the bottom of a window and a window parapet, when a user of the display apparatus desires to secure the display apparatus in a window.

2. A decorative cordless light emission element display apparatus comprising:

a plurality of light emitting elements;

a housing having a front surface, a back surface, first and second side surfaces, top and bottom surfaces, a surface of the housing defining a plurality of apertures therethrough for receiving and retaining in a reversible manner, the plurality of light emitting elements;

a plurality of support members coupled with a portion of the housing; a hook coupled with a portion of the housing; and a power supply in operative relation with the plurality of light emitting elements and coupled within the housing;

wherein the plurality of support members further comprising actuator for allowing the housing to move in a telescoping manner along the longitude of the support member so as to allow the light emitting elements to be displayed a variety of different heights with respect to the window parapet.

3. A decorative cordless light emission element display apparatus for easy installation in a window, comprising:

a plurality of light emitting elements;

a sturdy translucent plastic housing, having a front surface, a back surface, first and second side surfaces, top and bottom surfaces, a surface of the housing defining a plurality of apertures therethrough for receiving and retaining, in a reversible manner, the plurality of light emitting elements, the housing further comprising a front and back portion, the back portion having a cover portion, that substantially covers the back of the housing, the cover portion being removable and wherein the back portion of the housing further comprises a power source compartment, the power source compartment having a cover portion, that is removable;

a battery in operative relation with the plurality of light emitting elements and coupled with the housing within the power source compartment; and a switch to turn the light emitting elements to an on or an off configuration; and a hook coupled with a portion of the housing for displaying the decorative cordless light emission element display.

4. The decorative cordless light emission element display apparatus of claim 3, further comprising a plurality of support members, extending both longitudinally and vertically with respect to the support surface, operatively coupled with a portion of the housing, the plurality of support members comprising an actuator for allowing the housing to move in a telescoping manner along the longitude of the support member so as to allow the light emitting elements to be displayed at a variety of different heights with respect to the support surface while the vertical portions of the support member are in contact with a portion of the support surface.

5. The decorative cordless light emission element display apparatus of claim 4, wherein the battery is a nine-volt battery.

6. A decorative cordless light emission element display apparatus comprising:

a plurality of light emitting elements;

a sturdy plastic housing, the housing defining a plurality of apertures therethrough for receiving and retaining in a reversible manner, the plurality of light emitting elements;

a flange portion coupled with a portion of the housing, suitable for resting between a bottom portion of a window and a windowsill; and a solar power supply in operative relation with the plurality of light emitting elements and coupled within the housing, a circuit means operably coupled with the plurality of light emitting elements and disposed within the housing wherein the light emitting elements illuminate when it is substantially dark and do not illuminate when it is substantially light.

7. The decorative cordless light emission element display apparatus of claim 6, further comprising a hook coupled with a portion of the housing.

8. A decorative cordless light emission element display apparatus comprising:

a plurality of light emitting elements;

a sturdy plastic housing, the housing defining a plurality of apertures therethrough for receiving and retaining in a reversible manner, the plurality of light emitting elements;

a flange portion coupled with a portion of the housing, suitable for resting between a bottom portion of a window and a windowsill; and a solar power supply in operative relation with the plurality of light emitting elements and coupled within the housing, the solar power supply having a rechargeable battery and a circuit means operably coupled with the plurality of light emitting elements and disposed within the housing wherein the light emitting elements illuminate when it is substantially dark and do not illuminate when it is substantially light.

* * * * *